United States Patent [19]

Adams

[11] 4,160,283

[45] Jul. 3, 1979

[54] MAGNETIZING AND DEMAGNETIZING TOOL

[75] Inventor: Ralph W. Adams, Plentywood, Mont.

[73] Assignee: Howard A. Spoklie, Plentywood, Mont. ; a part interest

[21] Appl. No.: 900,151

[22] Filed: Apr. 26, 1978

[51] Int. Cl.[2] ..... H01F 13/00

[52] U.S. Cl. ..... 361/143; 361/149

[58] Field of Search ..... 361/143, 149; 335/284

[56] References Cited

U.S. PATENT DOCUMENTS

| | | | |
|---|---|---|---|
| 575,679 | 1/1897 | Hussey | 335/284 |
| 2,125,628 | 8/1938 | Fredrickson | 175/21 |
| 2,996,863 | 8/1961 | Odell | 53/236 |
| 3,086,148 | 4/1963 | Soneki | 361/143 |
| 3,303,398 | 2/1967 | Barta et al. | 361/143 |
| 3,467,926 | 9/1969 | Smith | 335/284 |
| 3,662,303 | 5/1972 | Arllof | 335/284 |

*Primary Examiner*—J D Miller

*Assistant Examiner*—L. C. Schroeder

*Attorney, Agent, or Firm*—Burd, Braddock & Bartz

[57] ABSTRACT

A magnetizable iron core is surrounded by a magnetizing solenoid coil which can be energized by 60 hertz regular house power. An article of magnetizable material to be magnetized is placed adjacent the core and the solenoid coil is energized. A normally closed dwell switch in series with the solenoid coil is activated by the magnetization of the iron core to move to an open condition to interrupt flow to the solenoid after first permitting current to flow in said solenoid coil momentarily. Upon sucn interruption of current flow to the solenoid, the article is magnetized. To demagnetize an article, it is put in contact with the iron core, and means is provided to override the dwell switch. The solenoid coil is continuously energized. The article to be demagnetized is then moved away from the iron core. The resulting decreasing alternating current field completely demagnetizes the article.

5 Claims, 6 Drawing Figures

MAGNETIZING AND DEMAGNETIZING TOOL

BACKGROUND OF INVENTION

This invention has relation to a tool for magnetizing and demagnetizing such articles as iron screwdrivers, for example.

It is known to magnetize soft iron articles such as screwdrivers by placing such article in close proximity to a permanent bar magnet. See U.S. Pat. No. 3,662,303, granted to Arllof in May of 1972; U.S. Pat. No. 3,467,926, granted to Smith in September of 1969; and U.S. Pat. No. 575,679, granted to Hussey in January of 1897.

It is also known to magnetize and to demagnetize using involved, intricate and expensive apparatus and circuits employing direct current surges. See U.S. Pat. No. 2,125,628, granted to Fredrickson in August of 1938 and U.S. Pat. No. 2,996,863, granted to Odell in August of 1961.

Intricate, expensive and elaborate circuitry and apparatus have been employed to demagnetize soft iron articles by providing an alternating current field associated with a demagnetizing coil from which the article to be demagnetized can be withdrawn. See U.S. Pat. No. 3,086,148, granted to Soneki in April of 1963.

Expensive and intricate and involved circuitry and apparatus has been provided to charge a condenser and to discharge the condenser through a coil to magnetize soft iron articles; while at the same time providing circuitry and apparatus to demagnetize by supplying alternating polarity electric current to a coil while the article to be demagnetized is withdrawn from the vicinity of the coil. See U.S. Pat. No. 3,303,398, granted to Barta et al in February of 1967.

None of these prior patents, and no other prior art of which the present applicant and his agents are aware can be utilized to provide a low cost tool directly utilizing ordinary house power and only two movable switches together with a solenoid coil and an iron core to provide a tool which can selectively magnetize or demagnetize soft iron articles.

BRIEF SUMMARY OF INVENTION

A combination magnetizing and demagnetizing tool consists of a box or case in which is mounted a solenoid coil in surrounding relationship to a magnetizable core, the core being aligned with a portion of the case where articles to be magnetized can be placed in adjacent relationship to the core. A normally open power switch means is provided to connect the solenoid coil across an alternating current source. A normally closed dwell switch is provided in series with the solenoid coil to be activated by the action of the solenoid coil in the magnetizable metal core upon closing of the normally open switch. In the form of the invention shown, the operation of the solenoid coil and the magnetizable magnetic core is to move a portion of the dwell switch toward the core, and this dwell switch movement is such as to initially maintain the switch in closed condition to continue power to the solenoid coil and to finally move to open position to interrupt the current to the solenoid coil. This leaves any magnetizable article held in adjacent alignment with the magnetizable core in a magnetized condition. The amount of magnetization achieved in such article is dependent on the relationship between the positioning of the closest portion of that article to the center of the magnetic field set up by the solenoid in the magnetizable core.

Reset and disabling means is provided to override or disable the action of the dwell switch. An article to be demagnetized can be initially positioned in the field set up by the solenoid coil and the core and can be demagnetized as the disabling means is actuated to override the dwell switch and the normally open power switch is held closed to set up a constantly alternating magnetic field in the core, and the article to be demagnetized is removed from that field.

In the drawings

DESCRIPTION OF PREFERRED EMBODIMENT

Figure 1:
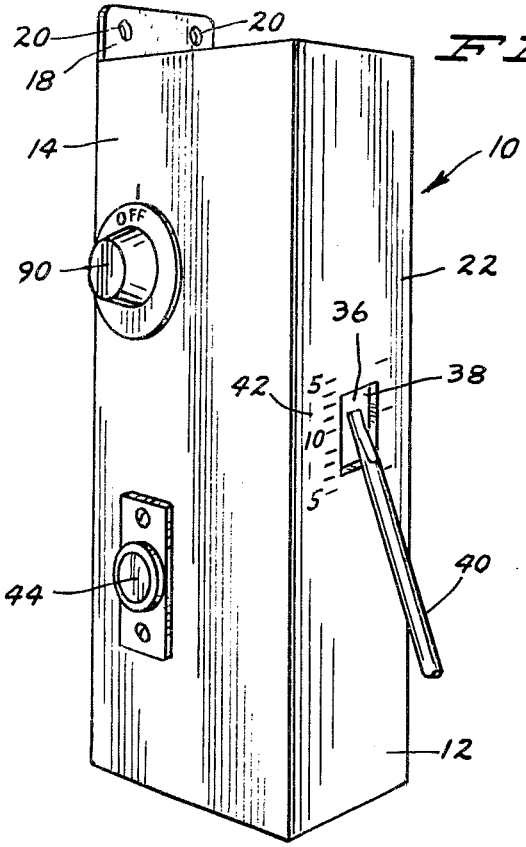
FIG. 1 is a perspective view of the tool of the present invention showing the relationship between a magnetizable core, and a screwdriver to be magnetized or demagnetized positioned with respect to the core.

A combination magnetizing and demagnetizing tool 10 includes a box or case 12 having a front wall 14, a back wall 16, an inner edge wall 18 provided with openings 20,20 by which the case can be affixed in an upright position on a workshop wall or the like (not shown), an outer edge wall 22, a top wall 24 and a bottom wall or floor 26.

An electric power cord 28 connects incoming electric lines 30 and 32 with a source of alternating current electrical power such, for example, as 110 volt 60 hertz house power from a source not shown.

A solenoid coil 34 is affixed to the outer edge wall 22 of the case 12 and is situated in surrounding relationship to a magnetizable core such as an iron core 36. An opening 38 is provided in the outer edge wall 22 to allow an article to be magnetized or demagnetized such, for example, as a screwdriver bit 40 to be brought into direct contact with the core 36. Indicia 42 is running from a highest number outwardly in both directions to lower numbers indicates the alignment position of an article to be magnetized with respect to the center of the axis of the magnetic field set up by the solenoid coil 34 and the iron core 36.

A normally open power switch 44, for example of the doorbell type, has one terminal connected to the incoming electric power line 30 and another terminal connected through electric line 46 to a first movable contact 48 of a dwell switch 50. A second contact 52 of the dwell switch 50 is connected by electric line 54 to a first solenoid coil lead wire 56 to the solenoid coil 34. A second solenoid coil lead wire 58 from the solenoid coil 34 connects directly to and is an extension of incoming electric power line 32.

Figure 5:
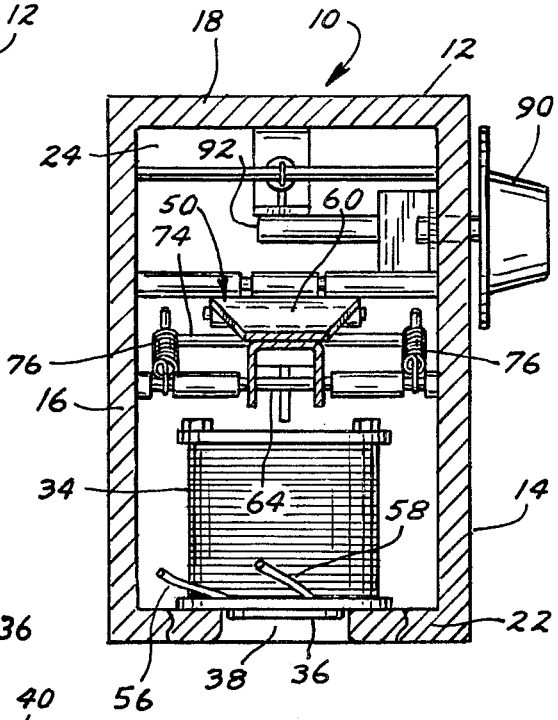
FIG. 5 is a horizontal sectional view taken on the line 5—5 in FIG. 3.
Figure 6:
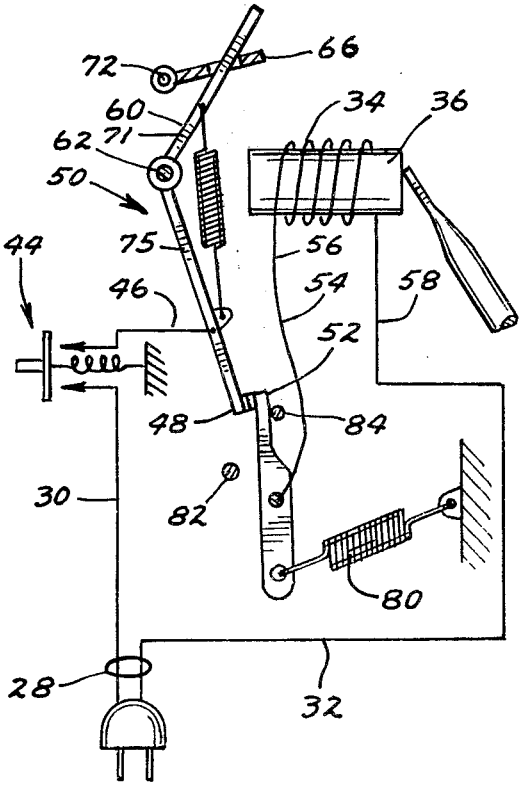
FIG. 6 is a pictorial and schematic representation of the electrical, magnetic and switching elements of the invention.

In the form of the invention shown, the dwell switch 50 includes an iron strap hinge 60 having a hinge pin 62 aligned with the axis of solenoid coil 34. The iron strap hinge 60 is, however, pivotally mounted on a pivot pin 64 which is fixedly mounted in front wall 14 and back wall 16 as best seen in FIG. 5.

A dwell switch strap hinge keeper plate 66 is provided with an opening 68 therethrough which receives an upper hinge extension arm 70 which is integral with an upper hinge strap 71 of hinge 60. The keeper plate 66 is freely pivotal around a keeper plate pivot pin 72. This pivot pin 72 is also fixedly mounted in front wall 14 and back wall 16 of the case 12. See FIG. 3.

The upper strap 71 of the hinge 60 is provided with an integral wire spring yoke 74, and a pair of over-center tensioning springs 76,76 are supported in tension between outer ends of the yoke 74 and the hinge pivot pin 64.

First movable contact 48 of dwell switch 50 is integral with a lower hinge strap 75 of the hinge 60, and second contact 52 of dwell switch 50 is mounted on a dwell switch contact arm 77 which pivots freely on a dwell switch contact arm pivot pin 78. This pivot pin 78 is also fixedly mounted in front wall 14 and back wall 16 of case 12. See FIGS. 3 and 4.

Figure 3:
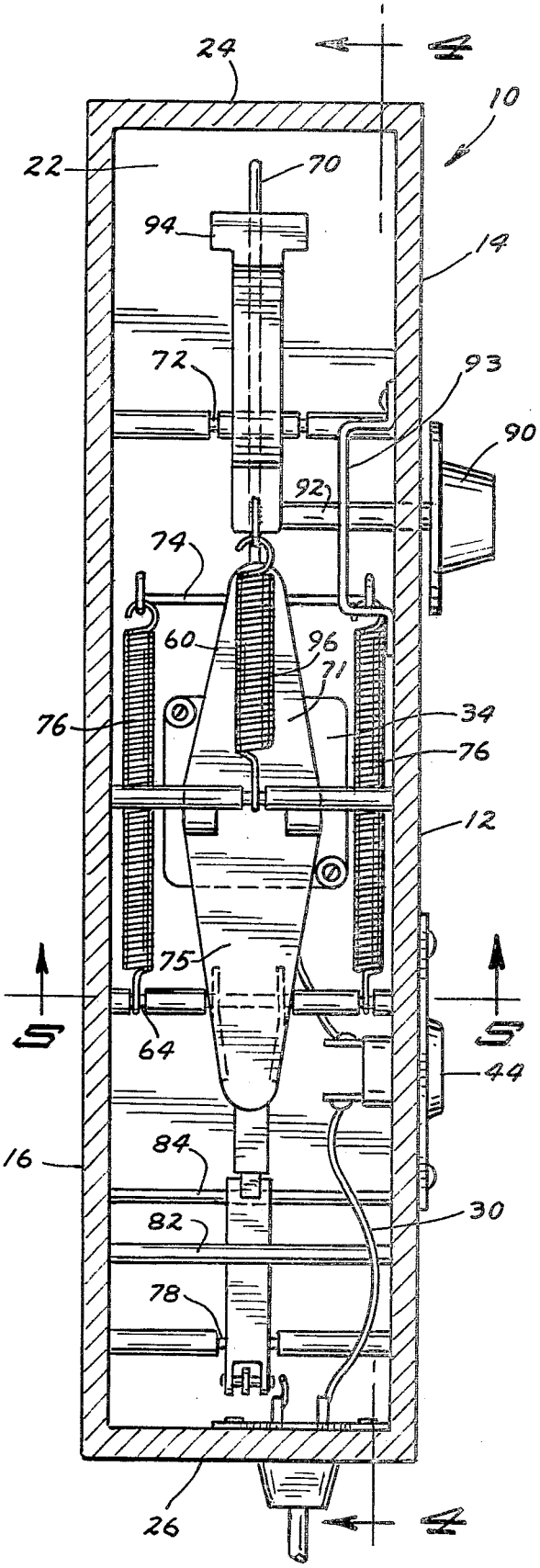
FIG. 3 is an enlarged vertical sectional view taken on the line 3—3 in FIG. 2.
Figure 4:
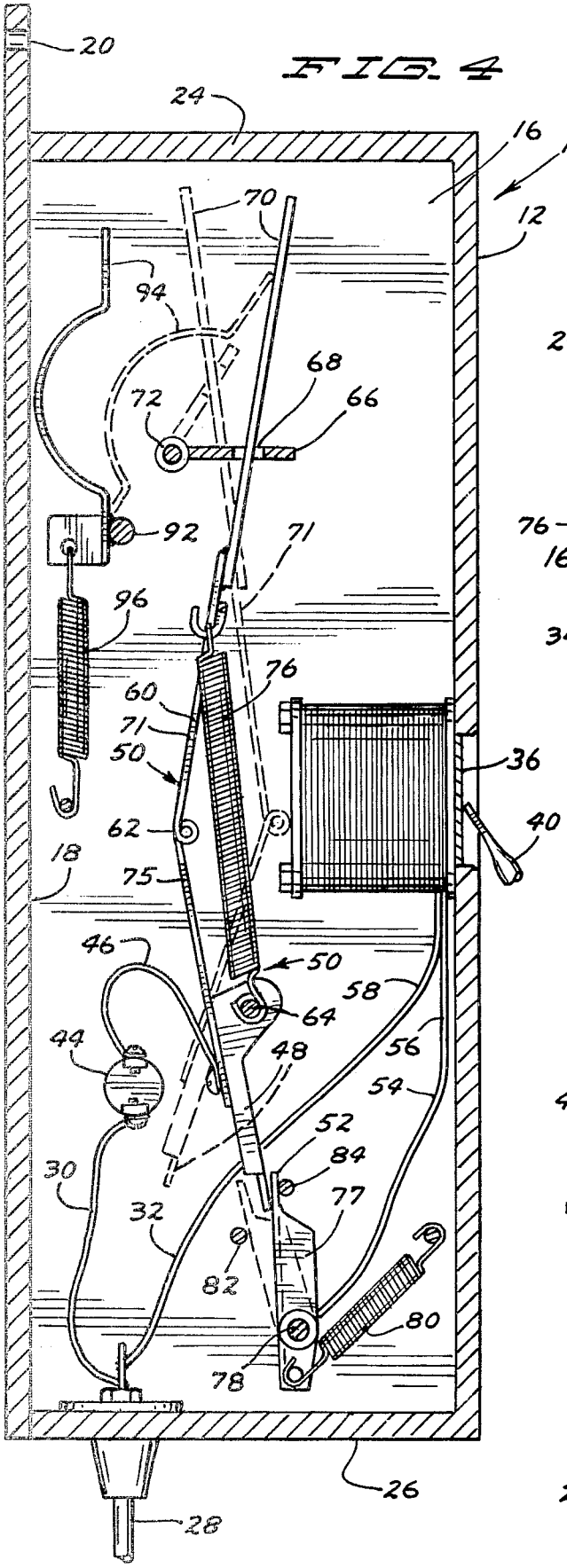
FIG. 4 is a vertical sectional view taken on the line 4—4 in FIG. 3.

A dwell switch contact arm tension spring 80 is connected between the lower end of contact arm 77 and the back wall 16 of the case 12 to constantly urge the contact arm 77 to turn in a counterclockwise direction as seen in FIG. 4. A dwell switch contact arm limit bar 82 is positioned between the front wall 14 and the back wall 16 of the case, as best seen in FIG. 3, and limits movement of the dwell switch contact arm 77 in counterclockwise direction as seen in FIG. 4. A dwell switch contact arm positioning bar 84 is also supported in those walls of case 12 and establishes the position of the contact arm 77 when the dwell switch is in cocked position as seen in full lines in FIG. 4.

A dwell switch reset and disabling knob 90 is integral with a reset arm pivot shaft 92 which is pivotally mounted in the front wall 14 of the case 12 as at 93 and as best seen in FIG. 3. A reset and disabling arm 94 is integral with and turns with the reset arm pivot shaft 92 and knob 90 from position as seen in full lines in FIG. 4 to position as seen in dotted lines in that figure. Arm 94 is in alignment with upper hinge extension arm 70 and moves it and hinge 60 from position as seen in dotted lines to position as seen in full lines in FIG. 4 to cock dwell switch 50.

A reset arm biasing spring 96 is connected in tension between the reset arm 94 and the back wall 16 of the case 12 to constantly urge the reset arm 94 in counterclockwise direction as seen in full lines in that figure.

OPERATION

Magnetization:

In order to magnetize an article such as screwdriver bit 40, the combination magnetizing and demagnetizing tool 10 of the invention will be placed in upright position as by supporting it on a vertical wall with fasteners through openings 20,20 in inner edge wall 18 of the case 12. This will align the parts so that gravity will have no effect one way or the other on the operation of dwell switch 50.

Figure 2:
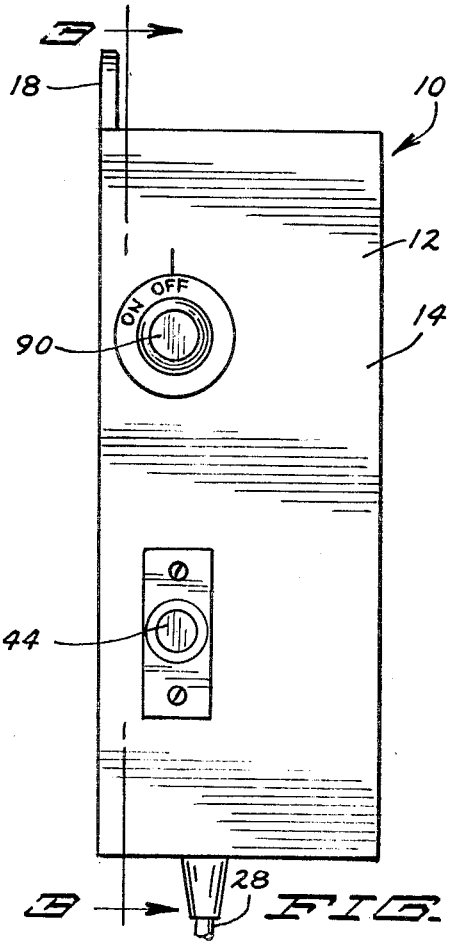
FIG. 2 is a front plan view of the tool of FIG. 1.

Dwell switch reset and disabling knob 90 will be turned to the limit of its movement in clockwise direction as seen in FIGS. 1, 2 and 4 to insure that the dwell switch 50 is cocked to have the hinge pin 62 of the iron strap hinge 60 located in spaced relationship with respect to the solenoid coil 34 and core 36, as seen in full lines in FIG. 4. Over-center tensioning springs 76,76 will tend to maintain the dwell switch 50 in this cocked condition until solenoid coil 34 is energized.

The reset knob 90 will then be released to allow the reset and disabling arm 94 to move clear of the dwell switch 50 so as not to impede the action of that switch during the magnetization procedure.

Next the article to be magnetized, for example screwdriver bit 40, is placed in adjacent, preferably contacting, relationship with respect to the face of iron core 36, through the opening 38 in the outer edge wall 22 of the case 12 in the form of the invention as shown. If maximum magnetization is desired or required, the screwdriver 40 will be brought in contact with the face of the core 36 as close as possible to the center of the magnetic field which is to be established through the core and through the solenoid coil 34. If less than full magnetization is desired, the contact between the screwdriver bit 40 and the face of iron core 36 will be out of alignment with the center of the magnetizing field to be produced. Indicia 42, inscribed on the outer surface of the outer edge wall 22 of the case 12 in the form of the invention as shown, extends from a highest number (10 as shown) to lower numbers running in both directions away from the center of the field. Use of these numbers will allow the operator to consistently return to the same position to attain the same degree of magnetization desired.

With the screwdriver bit 40 placed in the desired position, normally open power switch 44 is actuated to complete a series circuit from incoming AC power lines 30 and 32, through power switch 44, first movable contact 48 and second contact 52 of dwell switch 50, and through solenoid coil 34.

Current flowing in solenoid coil 34 will set up immediately a continuously reversing magnetic field through the iron core 36, and this field will attract iron strap hinge 60 to cause the hinge pin 62 to move in direction toward the iron core 36. This movement will continue until the hinge pin 62 is in contact with the solenoid coil and iron core assembly as shown in dotted lines in FIG. 4. This causes a clockwise movement of the first movable contact 48 as seen in FIG. 4. Dwell switch contact arm tension spring 80 will cause the dwell switch contact arm 77 carrying the second dwell switch contact 52 to move in counterclockwise direction and to maintain electrical contact between first contact 48 and second contact 52 until contact arm 77 comes to the limit of its movement against dwell switch contact arm limit bar 82. At this point the electrical circuit between contact 48 and contact 52 of dwell switch 50 will be broken, and the current in the solenoid coil 34 will be interrupted. Hinge pin 62 will by then have moved beyond the center axis of the over-center tensioning springs 76,76, however, so these springs will now cause the dwell switch to move to the position as seen in dotted lines in FIG. 4, insuring that no current will pass through the solenoid coil 34 whether or not the power switch 44 is maintained in closed condition.

It has been found that the sudden collapse of the magnetic field in the core 36 and the solenoid coil 34 upon the opening of contacts 48 and 52 of the dwell switch 50 will consistently impart a strong magnetizing force to the article, such as screwdriver bit 40, to be magnetized. The article will then retain this magnetization as it is moved away from the tool 10.

In order to be ready to utilize the tool 10 for further magnetization, dwell switch reset knob 90 will again be rotated to the limit of its travel in clockwise direction as seen in FIGS. 1, 2 and 4, to once again cock dwell switch 50.

Demagnetization:

To demagnetize an article such as screwdriver bit 40, for example, the screwdriver bit is placed in contact with the iron core 36 at the point of maximum magnetization as indicated by indicia 42. Dwell switch reset and disabling knob 90 is turned in clockwise direction as seen in FIGS. 1, 2 and 4 to the limit of its travel to positively hold upper hinge extension arm 70 of iron strap hinge 60 of the dwell switch 50 in the position as seen in full lines in FIG. 4. This position of the reset and disabling arm 94 is indicated in dotted lines in FIG. 4.

Power switch 44 is then closed, while maintaining the disabling arm 94 in the position as seen in dotted lines in FIG. 4, thus to cause current to flow continuously through the solenoid coil 34, setting up a continuously alternating magnetic field in the core 36.

While this field is so activated, the screwdriver bit 40 is simply removed from the vicinity of the tool thus moving it out of the continuous alternating magnetic field. This will completely demagnetize it.

As soon as this is accomplished, the normally open power switch 44 will be released to interrupt the current flowing through the solenoid coil 34.

The dwell switch reset and disabling knob 90 can then be released, leaving the dwell switch 50 in cocked position as seen in full lines in FIG. 4 and ready to perform the next desired magnetizing or demagnetizing operation.

The embodiments of the invention in which an exclusive property or privilege is claimed are defined as follows:

1. A magnetizing tool for use with a source of alternating electromotive force to magnetize a magnetizable object, said tool including a case; a magnetizable core mounted with respect to the case in position to allow a magnetizable object to be situated adjacent the core; a solenoid coil situated in surrounding relation to at least a portion of said core; power switch means for connecting said solenoid coil across a source of alternating electromotive force; and a normally closed dwell switch in series with said coil and activated by magnetization of said core to move to an open condition to interrupt flow of electrical energy through said solenoid after first permitting current to flow in said solenoid for a short period of time.

2. The magnetizing tool of claim 1 wherein said dwell switch includes a first movable portion made at least partly of a magnetically attractable material and having a first dwell switch contact thereon; a second movable portion with a second dwell switch contact thereon situated in aligned relation to the first dwell switch contact, said first portion being movable toward said core upon magnetization of said core; means biasing said second movable portion to move with said first portion to keep said first and second dwell switch contacts in electrical connection with each other during the initial movement of the first portion; and means to interrupt movement of said second portion while said first portion is still moving to break electrical connection of said first and second dwell switch contacts to stop flow of electrical energy in the solenoid coil.

3. The magnetizing tool of claim 2; over-center means to initially bias said dwell switch to normally closed condition and to finally bias said dwell switch to normally open condition following movement of said dwell switch from open toward closed condition responsive to an alternating magnetic field set up in said core; and means to reset said dwell switch from said biased open to said biased closed condition.

4. A magnetizing and demagnetizing tool including the magnetizing tool of claim 1, and means to disable said dwell switch to permit an uninterrupted flow of alternating electrical energy to said coil while positioning of an object to be demagnetized in the magnetic field set up by the coil and core and during removal of said object from said magnetic field.

5. A magnetizing and demagnetizing tool including the magnetizing tool of claim 3; and means to disable said dwell switch to permit an uninterrupted flow of alternating electrical energy to said coil while positioning of an object to be demagnetized in the magnetic field set up by the coil and core and during removal of said object from said magnetic field.

* * * * *